US010713898B2

(12) United States Patent
Schultz

(10) Patent No.: US 10,713,898 B2
(45) Date of Patent: Jul. 14, 2020

(54) COIN TOSS GAMING MACHINE

(71) Applicant: Howard Schultz, Windsor, CA (US)

(72) Inventor: Howard Schultz, Windsor, CA (US)

( * ) Notice: Subject to any disclaimer, the term of this patent is extended or adjusted under 35 U.S.C. 154(b) by 13 days.

(21) Appl. No.: 16/124,044

(22) Filed: Sep. 6, 2018

(65) Prior Publication Data

US 2020/0082673 A1 Mar. 12, 2020

(51) Int. Cl.
*G07F 17/32* (2006.01)

(52) U.S. Cl.
CPC ..... *G07F 17/3288* (2013.01); *G07F 17/3209* (2013.01); *G07F 17/3211* (2013.01); *G07F 17/3227* (2013.01); *G07F 17/3262* (2013.01)

(58) Field of Classification Search
CPC ..... G07F 17/3211; G07F 17/3213
See application file for complete search history.

(56) References Cited

U.S. PATENT DOCUMENTS 60,421 A * 12/1866 Quincy ..... A63F 9/0406 273/145 D
148,374 A * 3/1874 Mains ..... A63F 9/0406 273/145 R
177,438 A * 5/1876 Thorne ..... A63F 9/0406 273/145 D
178,537 A * 6/1876 MacIntire ..... A63F 9/0406 273/145 D
497,314 A * 5/1893 French ..... G07F 5/00 194/299
503,403 A * 8/1893 Brinkman ..... A63F 9/0406 273/145 D
1,353,380 A * 9/1920 Church ..... A63F 9/0406 273/145 D
1,766,134 A * 6/1930 Lauterbach ..... A63F 9/0406 273/145 D
2,462,686 A * 2/1949 Stallard ..... A63F 9/0406 273/145 D
2,693,962 A * 11/1954 Stevens ..... G07F 17/3213 273/145 D
2,919,921 A * 1/1960 Berger ..... A63F 9/0406 273/145 D
3,582,075 A * 6/1971 Glass ..... A63F 9/0098 273/317
4,051,939 A * 10/1977 Murphy ..... G07F 17/3213 194/211
4,061,338 A * 12/1977 Goldberg ..... A63F 11/0011 273/144 B (Continued)

FOREIGN PATENT DOCUMENTS

CA 2481554 A1 * 7/2002 ..... G07F 17/32
CN 108922331 A * 11/2018
GB 2317749 A * 4/1998 ..... G07F 17/3213

OTHER PUBLICATIONS

Yutaka Nishiyama, "Pattern Matching Probabilities and Paradoxes as a New Variation on Penney's Coin Game", International Journal of Pure and Applied Mathematics, Feb. 11, 2010, p. 357-366, vol. 59 No. 3, Academic Publications.

*Primary Examiner* — Steven J Hylinski

(57) ABSTRACT

A recreational gaming machine, is provided having an electro-mechanical apparatus that tosses a fair coin type object such that the outcome of the tossing process is unpredictable. A sensor determines the heads or tails outcome of each coin toss with a system that allows a player to place wagers.

18 Claims, 11 Drawing Sheets

(56) References Cited

U.S. PATENT DOCUMENTS

| | | | | |
|---|---|---|---|---|
| 4,114,290 | A * | 9/1978 | Cooper | A63F 3/0415 273/145 CA |
| 4,272,082 | A * | 6/1981 | Shoemaker, Jr. | A63F 9/00 273/356 |
| 4,757,999 | A * | 7/1988 | Opresco | A63F 9/0079 273/129 AP |
| 5,417,435 | A * | 5/1995 | Peretz | A63F 9/02 273/355 |
| 5,445,138 | A * | 8/1995 | Faith | A63F 9/02 124/16 |
| 5,885,157 | A * | 3/1999 | Harada | A63F 9/04 273/145 A |
| 7,780,166 | B1 * | 8/2010 | Paxton | A63F 1/04 273/145 C |
| 8,215,640 | B2 * | 7/2012 | Sasaki | G07F 17/322 273/145 D |
| 8,758,109 | B2 | 6/2014 | Lutnick | |
| 9,685,043 | B2 * | 6/2017 | Naicker | G07F 17/326 |
| 2007/0069459 | A1 | 3/2007 | Guindulain Vidondo | |
| 2011/0018194 | A1 * | 1/2011 | Nicely | A63F 9/0406 273/145 CA |
| 2014/0349732 | A1 * | 11/2014 | Pawloski | G07F 17/34 463/20 |
| 2015/0161851 | A1 * | 6/2015 | Naicker | G07F 17/326 463/22 |

* cited by examiner

COIN TOSS GAMING MACHINE

INCORPORATION BY REFERENCE

Applicant incorporates by reference herein United publication by Yutaka Nishiyama, entitled "Pattern Matching Probabilities and Paradoxes as a New Variation on Penney's Coin Game," International Journal of Pure and Applied Mathematics, Volume 59 No. 3 2010, 357-366."

FIELD OF THE INVENTION

The field of invention relates to games of chance. Specifically, the present invention relates to a game of chance utilizing at least one coin and receiving at least one bet or wager from a participant, and providing a contingent reward.

BACKGROUND OF THE INVENTION

An interesting probability game of coin arrangement was described by Walter Penney in 1969. While the mathematical probabilities of various types of hypothetical games have been explored in the academic arena, the usefulness of games of chance often depend upon their implementation, adaptation, and subsequent design to a accommodate user's interest for enjoyment or monetary gain.

SUMMARY OF THE INVENTION

The instant invention relates to system and method of coin tossing and game of chance and receiving at least one bet or wager from a participant, and providing a contingent reward. More specifically, the instant invention provides an implementation of some of the theoretical mathematical principles in a concrete and definite form which appeals the interests of the user and provides a useful application of a game of chance. More specifically, a system and method according to the invention utilizes some of the aspects of the probability game coin arrangements described by Penney, and additional aspects in a new method and a novel embodiment.

The invention is designed to provide entertainment based on the non-intuitive mathematics underlying the theoretical Penney's Coin Game. See Walter Penney, Journal of Recreational Mathematics, October 1961, p. 241. Penny does not describe a machine used for placing wagers or for entertaining a player according to the invention. Applicant knows of no entertainment machine based on the Penney's Coin Game that has been built, used or sold by anyone else. Applicant submits that there has need a long-felt, and yet unmet need in the market for such a device in accordance with the invention.

A device according to the invention is entertaining to the general public and not just a mathematical curiosity to readers of mathematical journals. Furthermore, a method according to the invention which can be incorporated in the processing of such a device and including choosing and placing a wager on a sequence, and watching a random sequence of coin tosses unfold is likewise be entertaining. Applicant knows of no entertainment process or method based on the Penney's Coin Game that has been built, used or sold by anyone else. Applicant submits that there has need a long-felt, and yet unmet need in the market for such a device.

Accordingly, an embodiment of a coin toss gaming machine according to the invention includes a coin tossing apparatus, a sensor to determine the coin toss outcome; a player interface adapted to allow a user to place and receive bets and select various options; and a processing system to control coin toss apparatus and initiate a coin toss.

Furthermore, the coin toss gaming machine can include a flexible membrane; a transparent enclosure, and linear actuators.

In addition, the machine can further include a coin acceptance apparatus adapted to receive a coin supplied by a player, a sensor to determine coin characteristics; and a processor to ensure the coin is fair according to predetermined parameters, for example the weight of the coin.

Moreover, a further embodiment of a coin toss gaming machine according to the invention may include a sensor to determine a position of the coin; and having actuator processing to activate certain actuators according to certain protocols, such as activating actuators that are associated with the coin's position. In addition, an embodiment of the device can include a contingent reward delivery apparatus.

Furthermore, an embodiment of the machine can be provided with a player to allow a user select a player sequence; to generate a house sequence; to initiate at least one actual coin flip; to receive an outcome of the actual coin flip; to compare the player sequence, house sequence, and the coin flip outcome; and to allow a user to initiate at least one additional coin flip. The actual coin flip and the additional coin flips comprise an actual coin flip sequence which can be can then compared.

Furthermore, the player interface can be provided with processing to compare the player sequence, house sequence, and the actual coin flip sequence, whereby a comparison is obtained; and then to shift a comparison of said player sequence, house sequence, and said actual coin flip sequence until there is a match.

The system processing of the above device can provide processes according to the inventive method.

It is to be understood that both the foregoing description and the following description are exemplary and explanatory only and are not restrictive of the invention, as claimed. Specific examples are included in the following description for purposes of clarity, but various details can be changed within the scope of the present invention.

BRIEF DESCRIPTION OF THE DRAWINGS

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE INVENTION

Figure 1:
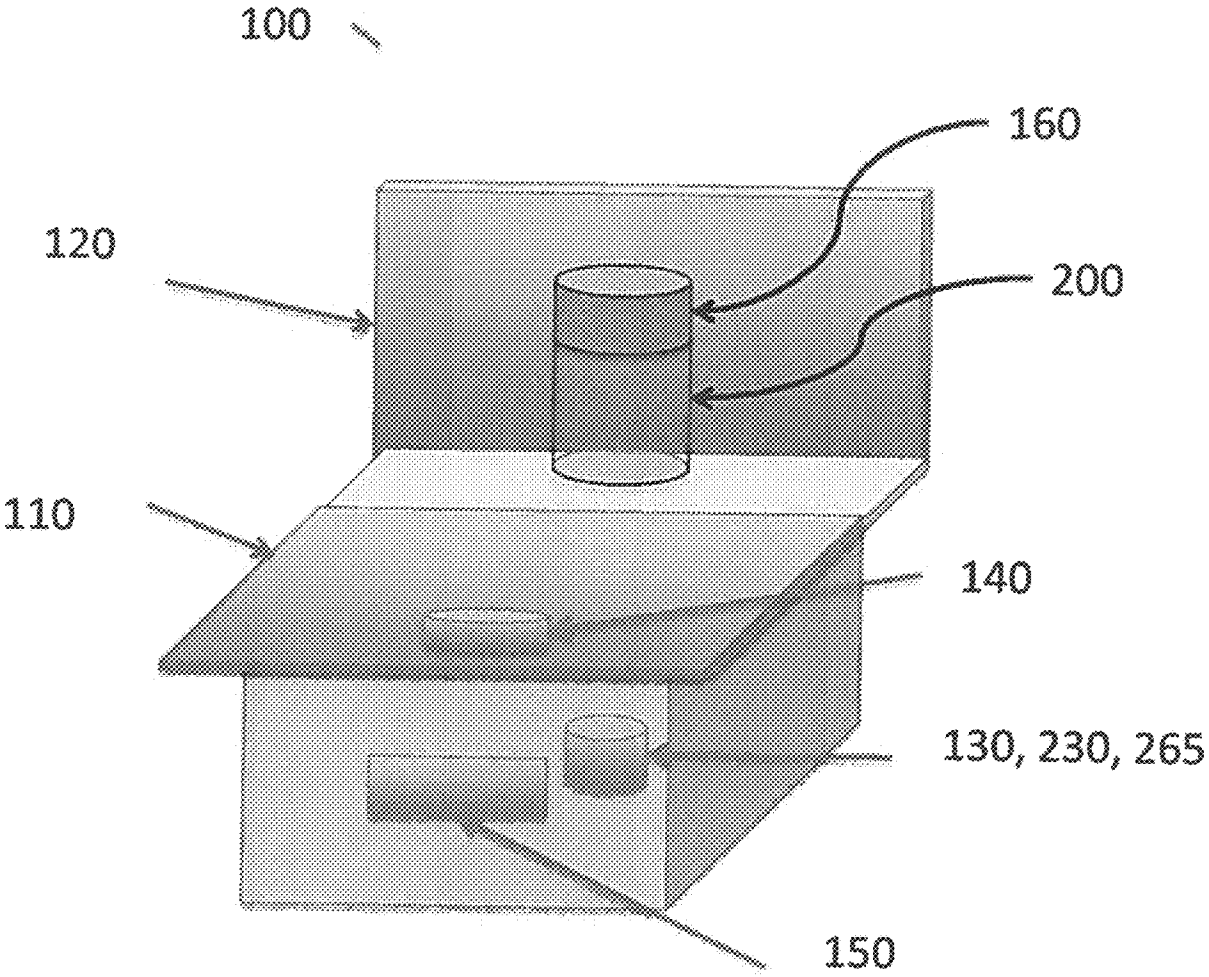
FIG. 1 is a schematic block diagram of one embodiment of the invention and depicting an example of a coin tossing apparatus according to the invention.

Referring to the drawing, FIG. 1 illustrates a preferred embodiment of system and method according to the invention. Specifically, a coin toss gaming machine is provided 100, which includes a coin tossing apparatus 200, a user interface 110, a display 120, and a processing system. In a further embodiment, according to the invention, the coin toss gaming machine includes a wager receipt apparatus 140, and a contingent reward delivery apparatus 150.

Figure 2:
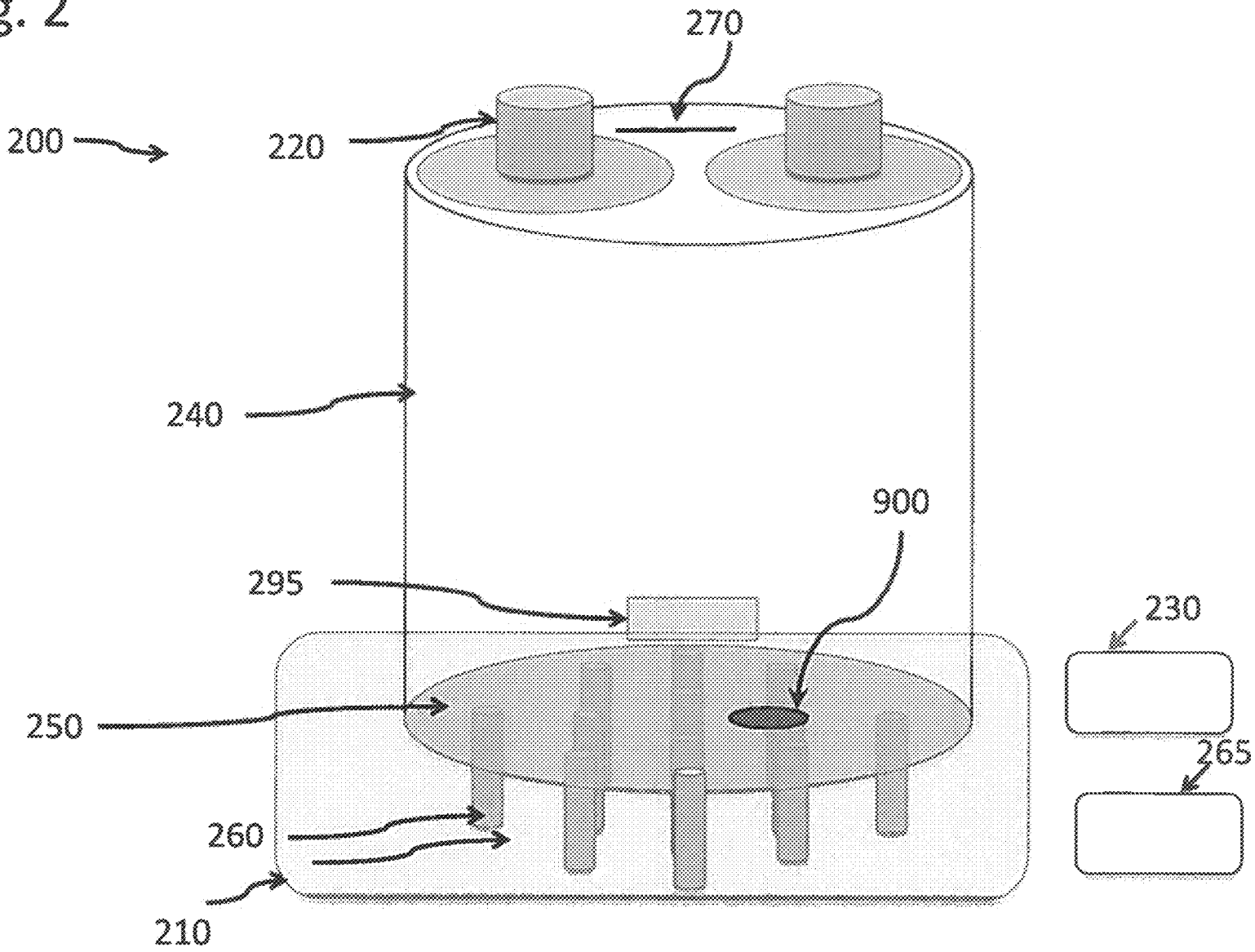
FIG. 2 is a schematic block diagram of a further embodiment of the invention and depicting an example of system of a gaming interface adapted for a coin tossing apparatus such as shown in FIG. 1.

FIG. 2 is a schematic block diagram of a further embodiment of the invention and depicting an example of system of a coin toss apparatus 200 adapted for an embodiment of a coin tossing apparatus such as shown in FIG. 1. An intention of an embodiment of the coin toss apparatus is to flip a coin such that the outcome is fair, and cannot be predicted by the initial state of the coin by the user.

In one embodiment, a coin toss apparatus 200 includes a transparent enclosure 240, and an electro-mechanical device 210 adapted to toss a fair coin object 900. The coin toss apparatus 200 also includes one or more sensors 220, which can be electronic and/or optical sensors systems, adapted to determine the position and/or outcome of a coin toss. The terms "coin toss" and "coin flip" as used herein are at times interchangeable. In general, a coin toss includes at least one flip of a coin, i.e., a causing a coin to perform at least one-half revolution about its axis to expose the opposing coin face. As contemplated herein, the invention provides at least one coin flip.

In one embodiment, the sensors 220 can be provided as two optical sensors, such as image sensors, video cameras, etc., and/or sensors systems having processing adapted to determine (1) a coin landing position where the coin landed and (2) a coin toss outcome, such as head or tails.

As used herein, "processing" includes one or more electronic processors which can be provided as an ASIC, or included with or as part of the processing system 130. Furthermore "processing" can also include machine readable instructions adapted to enable the processor or processors to perform a described function. Accordingly, the sensors 220 can be provided with separate sensor processing 230.

In a further embodiment, the sensors 220 provide information as to the location where the coin landed, or spot after the coin comes to rest after a coin toss, to a processor 230 which activates the linear actuators corresponding to a predetermined coin landing position corresponding to a detected coin landing position.

Accordingly, in a further embodiment, an actuator processor 265 can be provided determine which linear actuators to engage to produce the next coin toss. It should be noted that the actuators could be activated randomly or specific actuators could be activated to produce the most rotation and height of the next coin toss.

The actuator processor 265 can be provided, either as part of the processor 130, as a separate processor 265 or along with the linear actuators. The actuator processor 265 is provided with processing and/or programming to determine which linear actuators to assign to a corresponding detected landing position, such as according to a preferred kinetic protocol which can be set, such as high, medium, and low, or alternatively, can be set to give an optimal amount to rotational energy and height to the coin toss.

Alternatively, or in addition, one of the sensors, such as one camera is adapted to be used to determine the outcome of the coin toss, with no attempt to optimize the following coin toss. Accordingly, the actuators can be deployed according to a programmed manner, a random or predetermined sequence, or according to other inputs such as music. Random deployment of the actuators may result in a slower game. Separate processing can be provided depending on the complexity of protocols involved in the logic processes that determine which actuators are used after any given coin toss. It can be appreciated by one or ordinary skill in the art that the aesthetic value of the coin toss can be affected depending on the chosen embodiment, and fall within the scope of the invention. For example, if an embodiment includes accommodation for a user supplied coin, the system may also include additional processing to train or modify the operation of the sensors to identify head and tails, and train the actuators to accommodate the size, weight and other characteristic of the user supplied coin.

In one embodiment, the electromechanical device 210 acting as a coin tossing mechanism, includes a flexible membrane 250 and one or more linear actuators 260. When one or more of the linear actuators are activated, they can be disposed proximate to the membrane to strike the flexible membrane, which causes the flexible membrane to vibrate and thereby toss or flip a coin that may be disposed on the surface of the flexible membrane. Preferably, the linear actuators are on the bottom side of the flexible membrane and can be hidden from the view of a user. It can be appreciated by a person of ordinary skill in the art that devices equivalent to linear actuators can be used to affect the function of the one your actuators without departing the scope of the invention.

The enclosure 240 can be formed of a transparent material and surround or at least partially enclose a top portion of the flexible membrane in order to contain a coin that may be flipped within an area of the device and which can be viewed by a user. The transparent material can be formed of glass or plastic, among other things.

A fair coin 900 for use by the coin-tossing device, can be a government minted coin, or any other coined material, and can include a player supplied coin.

The one or more sensors 220 can include a camera or 3-D sensor in order for the device to determine the face value of the top surface a coin that is disposed on the flexible membrane. It can be appreciated by those skilled in the art that other sensors in a non-optical range insofar as the sensors may determine state of the coin and coin flip. Specifically, the one or more sensors can determine the result of a coin toss by recognizing the top surface of coin is a head or tail. It can be appreciated a person of ordinary skill in the art that variations of a fair coin 900 can include coins with other designations or values, and not only head or tail.

In addition, the one or more sensors can include a light for illuminating the area contained within the enclosure, and in particular the coin and flexible membrane.

In addition, or in the alternative, the coin tossing apparatus can include a user coin insertion slot 270 or other coin acceptance device 290. The user coin insertion slot 270 can be an aperture sized to accommodate insertion of a coin and is disposed at a portion of the enclosure whereby insertion of a coin by a user permits the coin to fall or be placed at a top portion of the flexible membrane 250, and susceptible to reading by the electronic sensor 220 for determination of a heads or tail status of the top surface of the coin.

In a further embodiment of the invention, a coin acceptance apparatus can be included adapted to receive a coin supplied by a player, and further is provided with a detector and processor adapted to ensure the coin is fair according to predetermined parameters.

In addition, or in the alternative, the coin tossing apparatus can include an access panel 280 and a retrieval aperture 295 whereby a user can retrieve a coin from within the enclosure.

Figure 3:
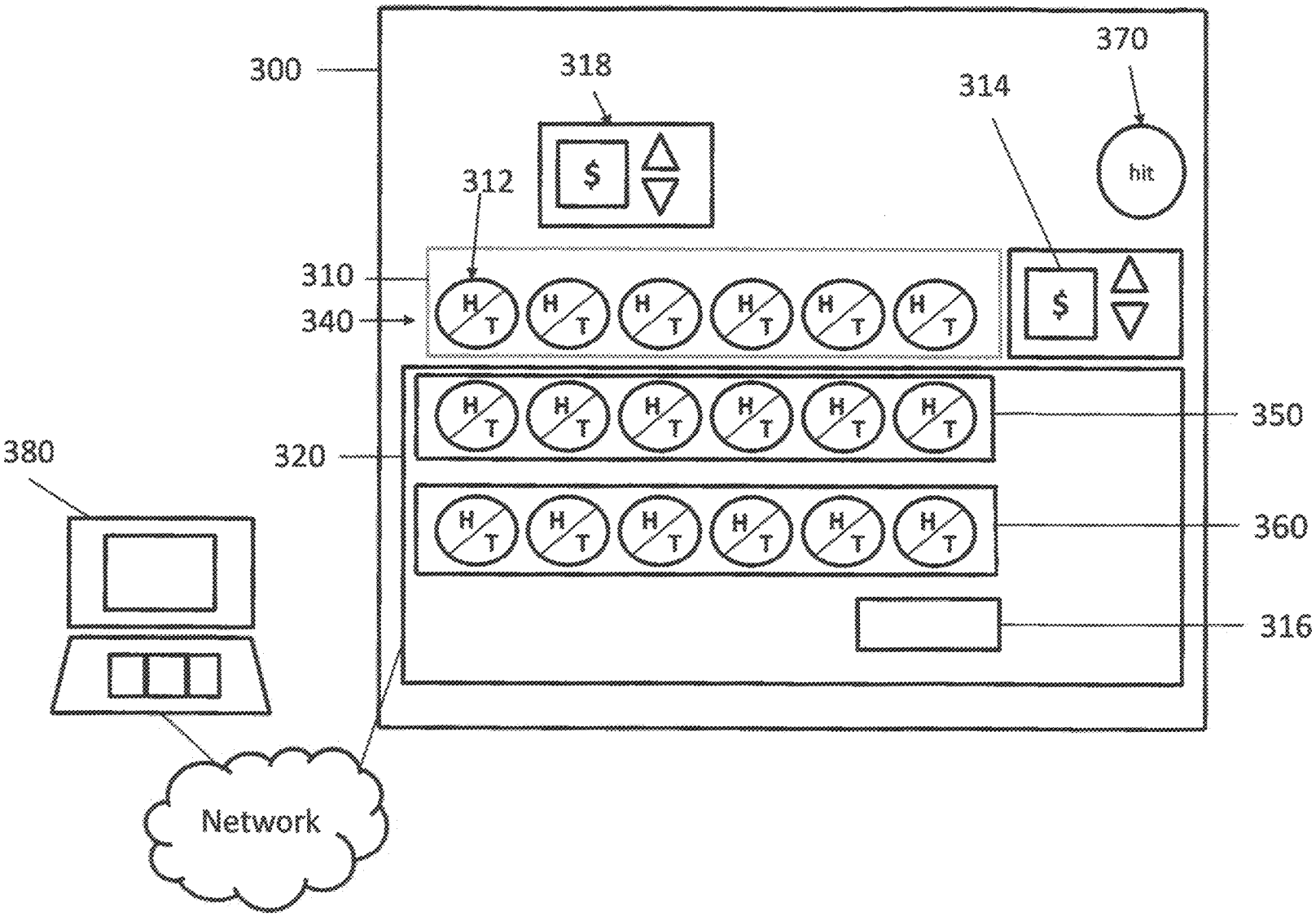
FIG. 3 is a diagram of a game user interface according to an embodiment of the invention.

FIG. 3 is a schematic block diagram of a further embodiment of the invention and depicting an example of a gaming interface adapted for an embodiment of a coin tossing apparatus such as shown in FIG. 1.

A player interface 300 permits a user or player to give instructions and information to the machine and to receive the displayed information to the enjoyment of the player. It permits a user to place and receive bets and select various options; and can include a processing system which is adapted to control the electro-mechanical coin toss apparatus, such as to initiate a coin tossing sequence, place wagers, select a coin sequence, show score among other things.

More specifically, the user interface 300 provides one or more user input selectors, and can include a player sequence selector 312. A coin value indicator 312 can be provided to show the value of the coin chosen by the player. The player uses the player sequence selector 310 to provide the players choice of heads or tails for each player selected coin in a sequence. In addition, the input selectors 310, can include a player wager input 314 whereby the player can provide a bet or wager.

In addition, or in the alternative, the player interface can be provided with a player sequence display 340 to display the players chosen sequence of heads or tails of anticipated coin toss, such as an image of the coin, or a representation of the image of the coin.

The display 320 also includes a house sequence display 350. The house sequence display 350 provides a display the house chosen sequence of heads or tails of anticipated coin toss, and likewise can be an image of the coin, or a representation of the image of the coin.

Furthermore, the display includes an actual coin toss sequence display 360. The actual coin toss sequence display 360 provides a display of the actual coin toss sequence as the coin is being tossed or in the alternative after the coin toss sequence has completed and provides a display to the player of the results of the coin toss.

It can be appreciated by a person of ordinary skill in the art that various programming can be provided to give effect to a method according to the invention. The processes can be programmed into one or more separately discrete units, such as the processing system 330, such as an electronic processor (or ASIC) and an electronic memory, as well as a general purpose computer.

At the beginning of each game, the user selects a sequence of coin tosses. The outcome of each coin toss can be either heads (H) or tails (T). An image of the heads and tails side of the coin as well as the sequence chosen by the player is clearly displayed on the user interface.

In one alternative embodiment, the number of tosses in the sequence can be selectable by the user using a user selected sequence length input 318.

In another embodiment, the minimum and maximum length of the sequence offered to the user can be provided in coordination with a further remote control system 380 under program control by an agent authorized to program the device.

A fair coin 900 to be used by the coin-tossing device can be included as part of the device, or supplied by the user. If the user supplies the coin, an alternative embodiment of the invention can include a coin acceptance device 270 which is adapted to determine the value of the coin and determine if the user-supplied coin is a fair coin. It can be appreciated by a person of ordinary skill in the art that additional mechanisms can be used in conjunction with the invention to ensure the fairness of the coin and to prevent cheating, such as devices known to includes sensors that determine whether a coin is comprised of substantially non-magnetic material, or to ensure the user supplied coin will be compatible with a device according to the invention, and not prone to damage or interfere with a gaming machine according to the invention.

Once the user selects a sequence, e.g., HTH, the game processing system 330 or computer selects a sequence, which is displayed on the user interface along with the user-selected sequence.

Once the user selects a valid length sequence and places a bet, the player initiates the game. The device uses the electro-mechanical coin tossing apparatus to toss the coin. After each coin toss, the outcome heads or tails is displayed on the user interface. The device continues to toss the coin until either the player's chosen sequence or the device's chosen sequence occurs. If the player's chosen sequence occurs first, the player wins. If the device's chosen sequence occurs first, the player loses.

Also shown in FIG. 1, in one embodiment the invention, a wager receipt apparatus is provided for receipt of a player's wager. Likewise, a contingent reward delivery apparatus can be provided for delivering a reward to a player, such as in the case of a win notification.

Figure 4:
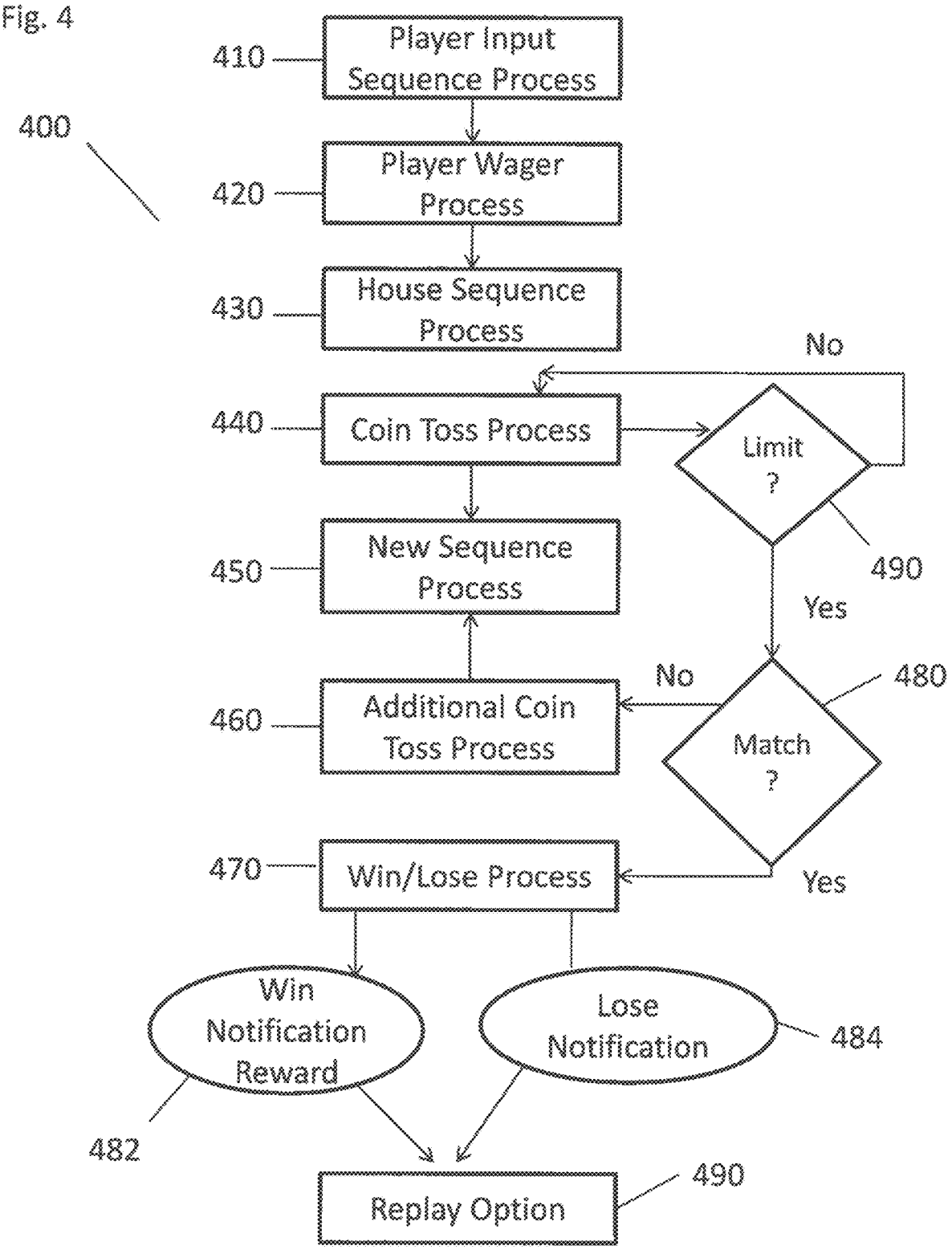
FIG. 4 is a flow chart diagram of an embodiment of the invention depicting a process of according to the invention

In reference to FIG. 4, an embodiment of a method according to the invention is shown comprising several steps. It can be appreciated by those of us ordinary skill in the art that while FIG. 4 shows various steps in a method according to the invention in a particular order, variations in the order are contemplated without deviating from the scope of the invention.

In one step, a player sequence process 410 is provided. A player input sequence is provided whereby a player can use the player sequence selector to input a player sequence at a beginning of a game. The player can be prompted to select a player sequence comprising a plurality of coin toss outcomes. The player chooses a coin toss outcome from the group consisting of a head (H) and a tail (T) or other such designation as can be readily appreciated by person of ordinary skill in the art. The player sequence has a length and is limited to a sequence length limit.

In an alternative embodiment of the invention, a method according to the invention can also include selecting a sequence length limit. As described above, in one embodiment a player chooses a sequence length, and in another embodiment, a predetermined sequence length is provided, such as may be preprogrammed within a device, or supplied by a remote control system which can set a minimum and maximum sequence length.

As discussed above, such steps can be embodied in processing that is initiated by interaction of the player and user interface. Furthermore, the method includes displaying an image of the player sequence on a user interface. This provides confirmation of the players desired sequence. Each choice by the player is associated with a value to be compared by the processing system.

In one embodiment, the method also provides a player wager process 420 wherein a player can utilize the player interface to select a wager and in addition or the in the alternative make arrangement for payment of the wager. Once the player has provided a player input sequence and wager, the system and method can include the step whereby the player can initiate a house sequence process 430.

Accordingly, a further step in an embodiment of the invention is providing a house sequence process 430 at a beginning of a game. The processing system 330, or alternatively (not shown) a house machine selects the house sequence. The house sequence includes a number of coin toss outcomes equivalent to the coin toss limit. As before with the player, a house machine chooses a coin toss outcome from the group consisting of a head (H) and a tail (T), or other such designation as can be readily appreciated by person of ordinary skill in the art. The outcome is associated with a value in order to be compared to the player sequence by the processing system.

In addition, an embodiment of the method according to the invention includes the step of displaying an image of the house sequence on the user interface, whereby a player may visually compare the player sequence with the house sequence.

Furthermore, in an embodiment of a method according to the invention, the method includes the step of receiving instructions from a player to initiate a coin toss process 440.

Accordingly, the method includes a coin toss process whereby a machine or processor performs a number of actual and/or virtual coin tosses, up to the number of the sequence length limit. In one embodiment of the system and method according to the invention, once the player initiates the coin toss sequence, at least one processor 130, 330 provides instructions according to a predetermined protocol described above, to activate one or more linear actuators, such protocol, including activating actuators associated with a landing position of a coin, among other things. The linear actuators are caused to strike the flexible membrane, causing the coin to be tossed, and after a moment of time sufficient for the coin to settle, the coin toss process 440 includes activating the linear actuators again to toss the coin, until the number of coin tosses equals the sequence limit. The coin toss process continues in such manner until either of there is a match or a predetermined maximum coin flip limit has reached. Thus, a matching process 480 and limit test process 490 can be provided separately or as part of the coin toss process. Furthermore, a new sequence process 450, and an additional coin toss process for 60 can likewise be provided as part of the coin toss process 440 or as additional processes. In a further alternative embodiment of the invention, the method includes the user can initiate each subsequent coin toss.

Another step in one embodiment of a method according to the invention is detecting a value of each of the coin toss outcomes, and further displaying an image of the coin toss on the user interface. As before, such as step canning be included within the coin toss process 440 or matching process 480.

A further step can be provided separately or as part of the matching process 480, which step includes comparing or matching the actual coin toss sequence with the player sequence. In addition, an embodiment can include the step of providing a win notification if the coin toss sequence is equivalent to the player sequence, or alternatively providing a lose notification if said coin toss sequence is equivalent to said house sequence 470.

Furthermore, in one embodiment, the method includes comparing or matching values of the actual coin toss outcome with the house sequence.

Thereby, the player can watch the game unfold with each coin toss to the end of the coin toss sequence, and preferably experience a further heightened level of excitement or the alternative, a notification of loss of at least a first round of the players game.

If neither the player sequence nor house sequence provides a matching sequence to the actual coin toss sequence, further steps ensue.

A further embodiment of the method according to the invention includes steps of performing an additional actual coin toss 460, detecting an additional value of each of the additional coin toss outcome, and displaying an image of the additional coin toss on the user interface.

In addition, further steps provide for a new actual coin sequence for comparison to the player sequence and to the house sequence 450.

More specifically, a new sequence process 450 is provided wherein further steps are provided for comparing a new sequence, including appending the additional actual value to the actual coin toss sequence at the end of said sequence, and forming an additional or new coin toss sequence and shifting the compared coin sequences. Additional steps are comparing the values of the additional coin toss sequence with the player sequence, and providing a win notification if the additional coin toss sequence is equivalent to the player sequence, and alternatively comparing the values of the additional coin toss sequence with the first machine selected outcome, and providing a lose notification if the additional coin toss sequence is equivalent to said house sequence.

The above steps repeat until there is either a win notification or a loss notification 470; or until a predetermined limit.

Thereby, the player can watch the game unfold with each additional coin toss until there is a win or lose notification, and preferably experience a further heightened level of excitement. In addition, a win notification reward 482 and lose notification 484 can be provided with a replay option 490

Additional steps include providing choice to the player to continue a further round after a win or lose notification, and further providing a tally or score for each round that a player initiates.

FIGS. 5-9 are diagrams showing a game user interface according to an embodiment of the invention, and provide an example of use of such a coin toss device, and describe various steps in a method according to the invention.

Figure 5:
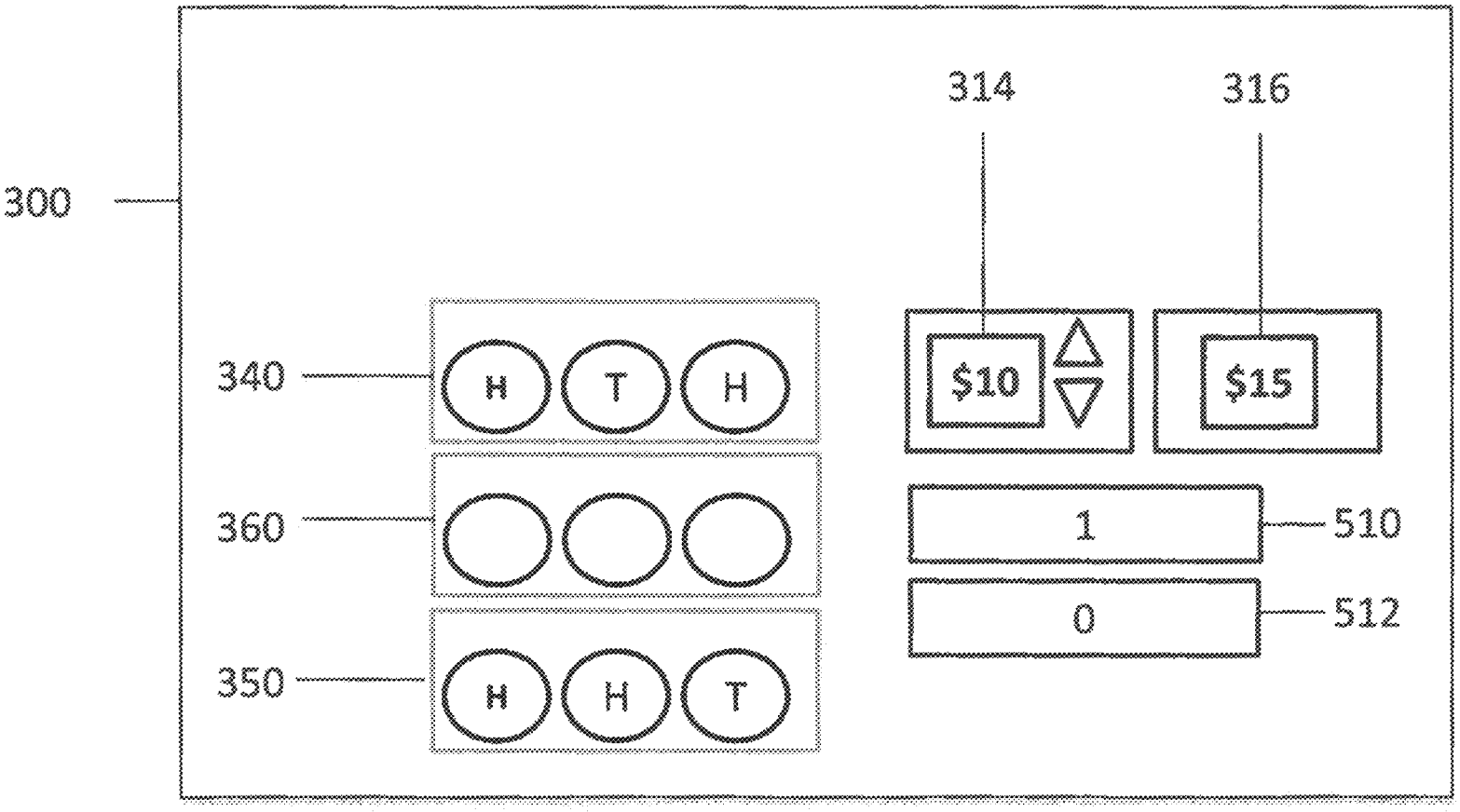
FIG. 5 is diagram of a game user interface according to an embodiment of the invention.

As shown in FIG. 5, a gaming interface has a display which can provide a player sequence 340, a house sequence 350, and an actual coin toss sequence 360. In addition, the display can show a player wager 314, as well as a payout display 316. The display can provide a number count 318 for each iteration of coin toss. As shown in FIG. 5, initially, a player a chooses a sequence and places a bet. Thereafter, the coin toss game machine provides the house sequence.

In this example, the player can then initiate a coin toss process. After the coin toss process has been completed, the gaming machine can display the results of the first coin toss.

Figure 6:
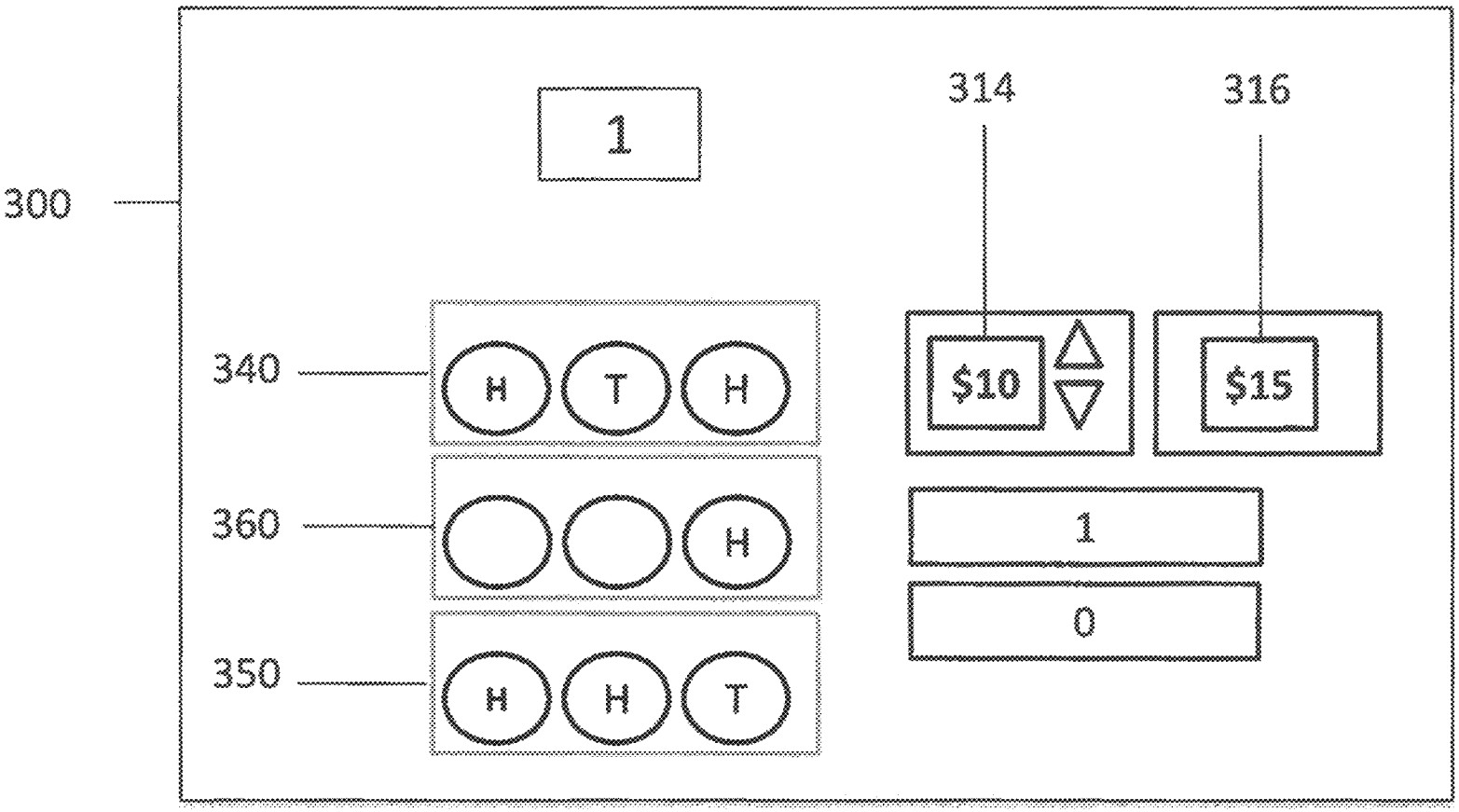
FIG. 6 is diagram of a game user interface according to an embodiment of the invention.

As shown in FIG. 6, an example of a first coin toss is shown as "H" within one area of the actual coin toss sequence display 360. In addition, the coin toss matching number 318 can increment to "1" to reflect a match between the user sequence and the actual sequence and the number of coins that match in the sequence. In this example, the number of coins matching is 1. It can be appreciated that the length of the sequence can be varied within the scope of the invention. The outcome of the coin-flips, described above, are provided herein as non-limiting examples to illustrate use of the method and device.

In this example the player can initiate a $2^{nd}$ coin toss sequence. After the $2^{nd}$ coin toss sequence has been completed, the gaming machine can display the results of the $2^{nd}$ coin toss.

Figure 7:
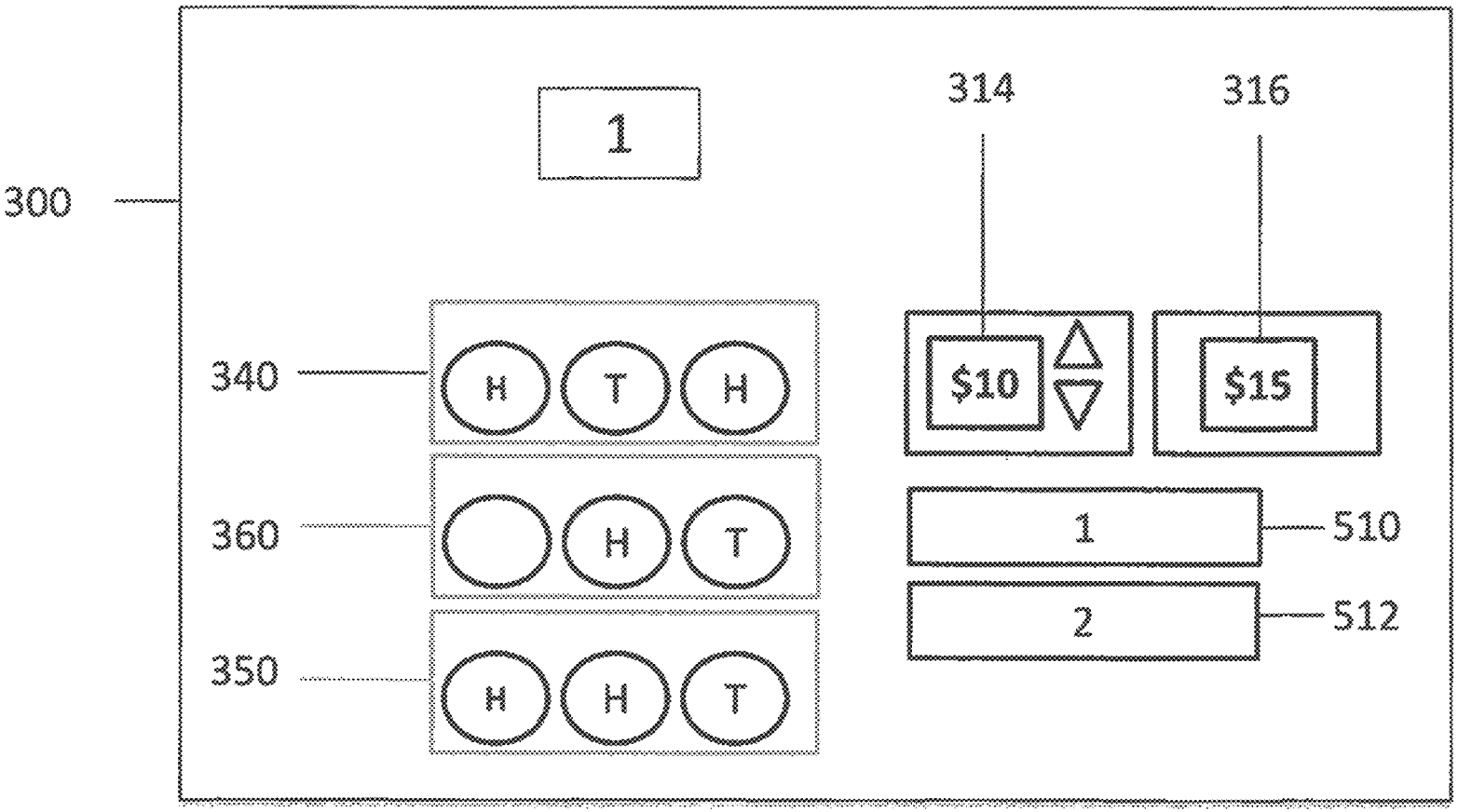
FIG. 7 is diagram of a game user interface according to an embodiment of the invention.

As shown in FIG. 7, an example of a $2^{nd}$ coin toss is shown as "T" within a $2^{nd}$ area of the actual coin toss sequence display 360. In addition, the player coin toss matching number 510 can increment to "2" to reflect a match between the user sequence and the actual sequence and the number of coins that match in the sequence. In this example, the number of coins matching is 2. Accordingly, after the coin toss sequence has been completed, a matching process can be provided for comparing the player sequence, house sequence and actual sequence. Thus, the matching process can provide the information regarding the number of matching coins. Again in this example, the number matching is 2.

Figure 8:
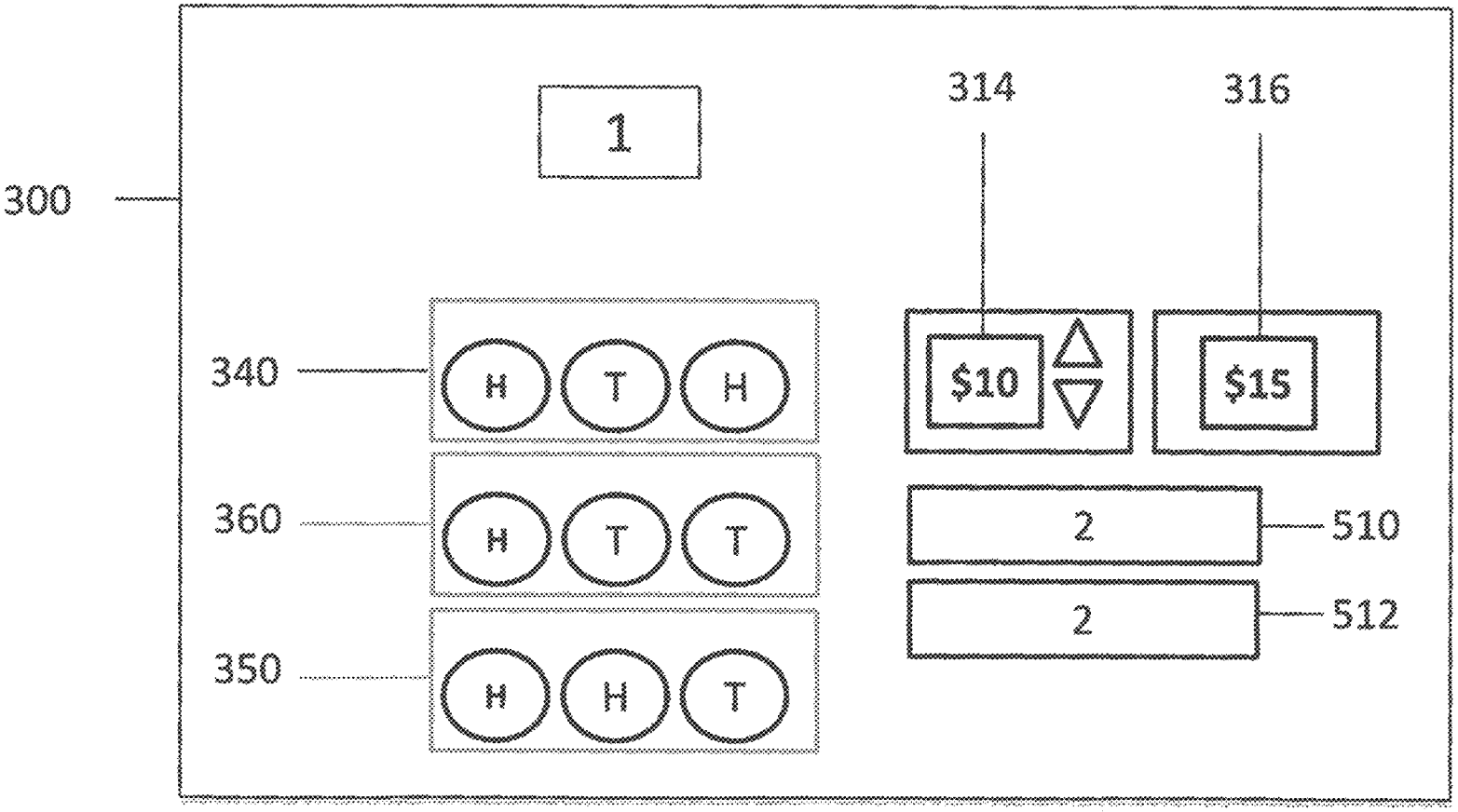
FIG. 8 is diagram of a game user interface according to an embodiment of the invention.

Furthermore, in this example the player can initiate a $3^{rd}$ coin toss sequence. After the $3^{rd}$ coin toss sequence has been completed, the gaming machine can display the results of the $3^{rd}$ coin toss. As shown in FIG. 8, an example of a $3^{rd}$ coin toss is shown as "T" within a $3^{rd}$ area of the actual coin toss sequence display 360. In addition, the coin toss matching number 318 can increment to "2" to reflect a match between the user sequence and the actual sequence and the number of coins that match in the sequence. In this example, the number of coins matching remains 2.

In addition, in this example the player can initiate a $3^{rd}$ coin toss sequence. After the $3^{rd}$ coin toss sequence has been completed, the gaming machine can display the results of the $3^{rd}$ coin toss.

As shown in FIG. 8, an example of a $3^{rd}$ coin toss is shown as "T" within a $3^{rd}$ area of the actual coin toss sequence display 360. In addition, the coin toss matching number 318 can increment to "2" to reflect a match between the user sequence and the actual sequence and the number of coins that match in the sequence. As described above such number can be provided by the matching process. In this example, the number of coins matching remains 2.

Furthermore, in this example the player can initiate a $4^{th}$ coin toss sequence. After the $4^{th}$ coin toss sequence has been completed, the gaming machine can display the results of the $4^{th}$ coin toss.

Figure 9:
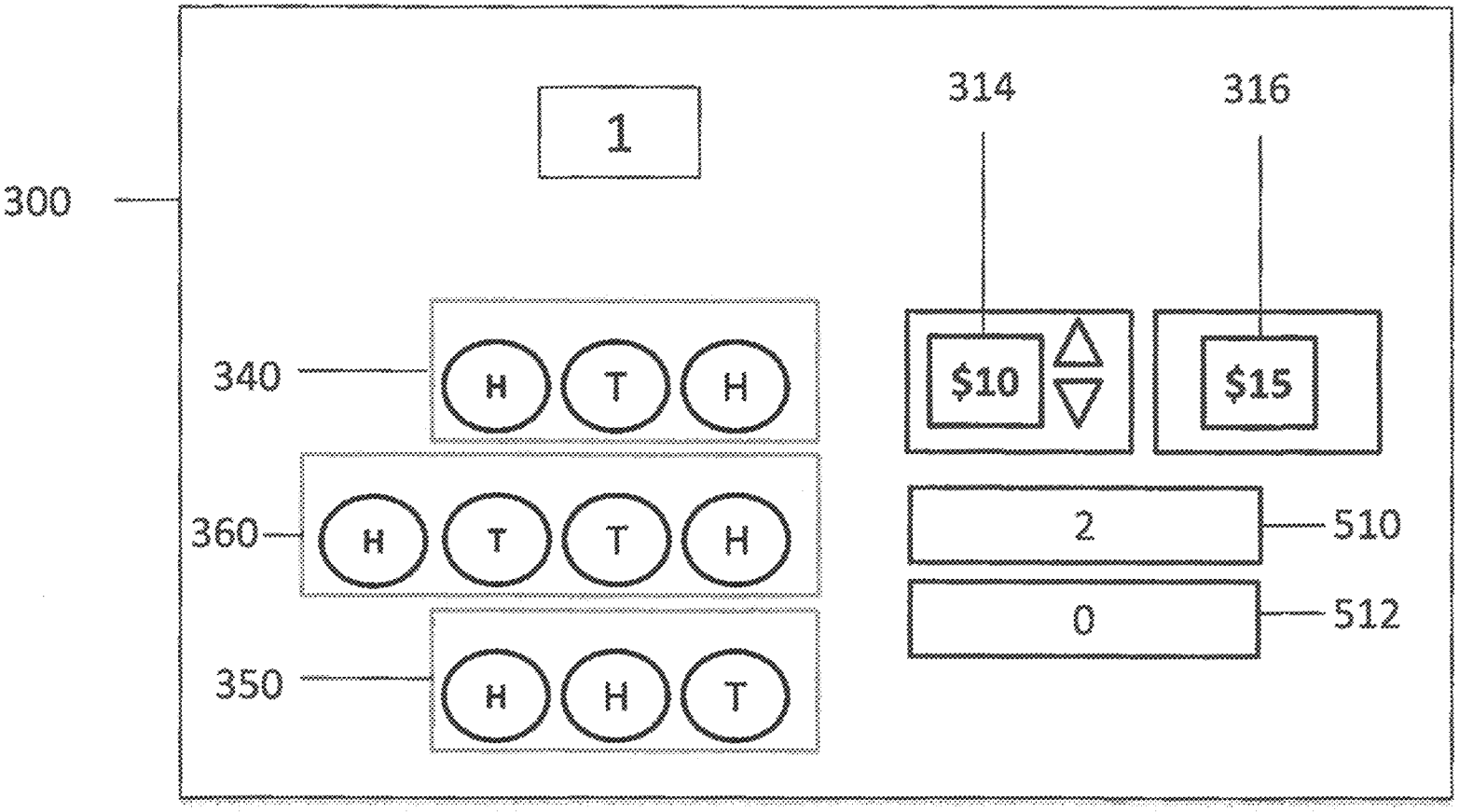
FIG. 9 is diagram of a game user interface according to an embodiment of the invention.

As shown in FIG. 9, an example of a $4^{th}$ coin toss is shown as "H" within a $4^{th}$ area of the actual coin toss sequence display 360. In addition, the coin toss matching number 318 can update to "1" to reflect a match between the user sequence and the actual sequence and the number of coins that match in the sequence. As described above such number can be provided by the matching process. In this example, the number of coins matching has been reduced to one as a consequence of a shifting of the actual coin toss sequence in comparison to the player sequence and house sequence.

Moreover, in this example the player can initiate a $5^{th}$ coin toss sequence. After the $5^{th}$ coin toss sequence has been completed, the gaming machine can display the results of the $5^{th}$ coin toss.

Figure 10:
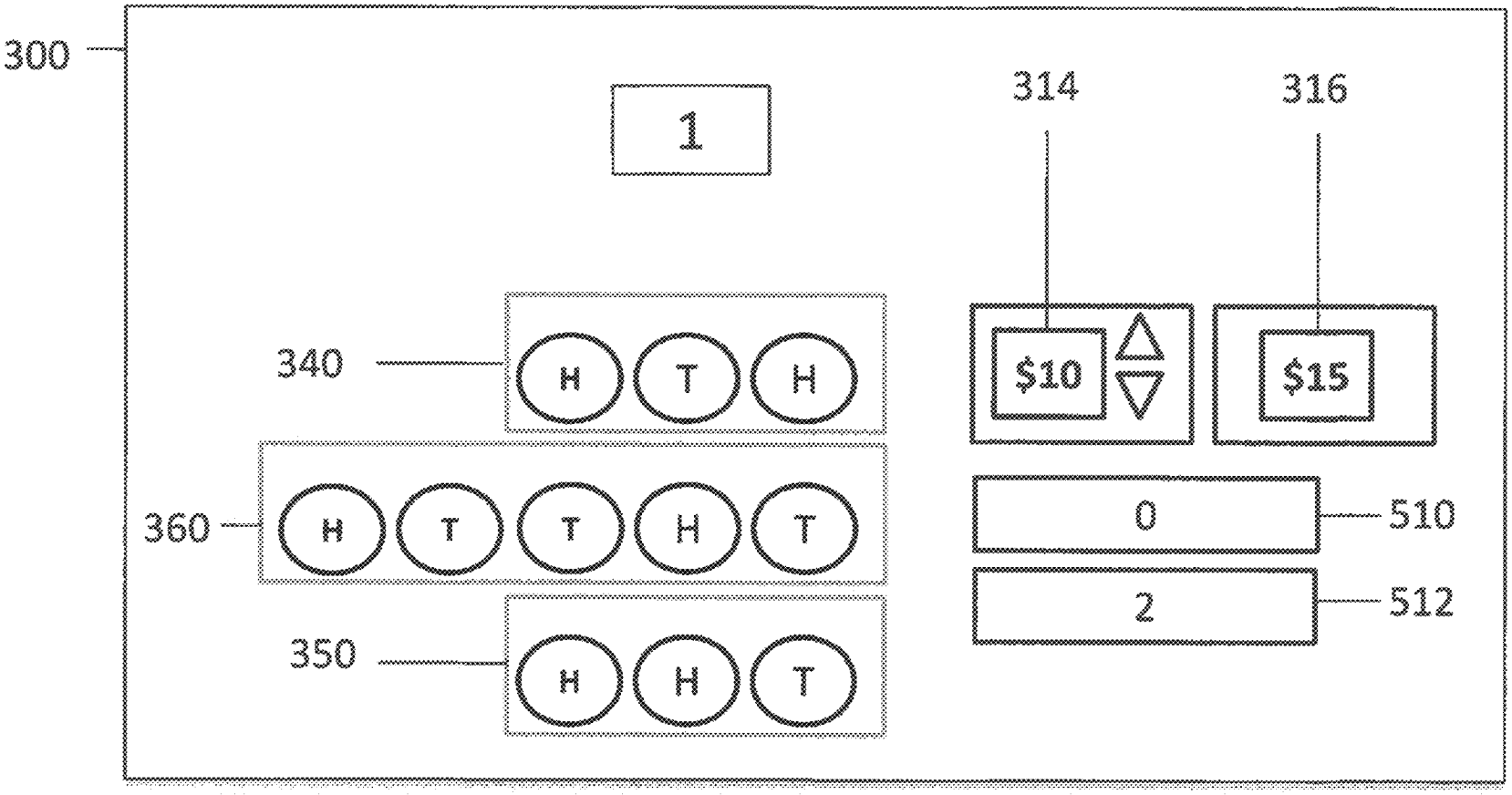
FIG. 10 is diagram of a game user interface according to an embodiment of the invention.

As shown in FIG. 10, an example of a $5^{th}$ coin toss is shown as "T" within a $5^{th}$ area of the actual coin toss sequence display 360. In addition, the coin toss matching number 318 can update to "2" to reflect a match between the user sequence and the actual sequence and the number of coins that match in the sequence. As described above such number can be provided by the matching process. In this example, the number of coins matching has been reduced to one the consequence of a shifting of the actual coin toss sequence in comparison to the player sequence and house sequence.

Moreover, in this example the player can initiate a $6^{th}$ coin toss sequence. After the $6^{th}$ coin toss sequence has been completed, the gaming machine can display the results of the $6^{th}$ coin toss.

Figure 11:
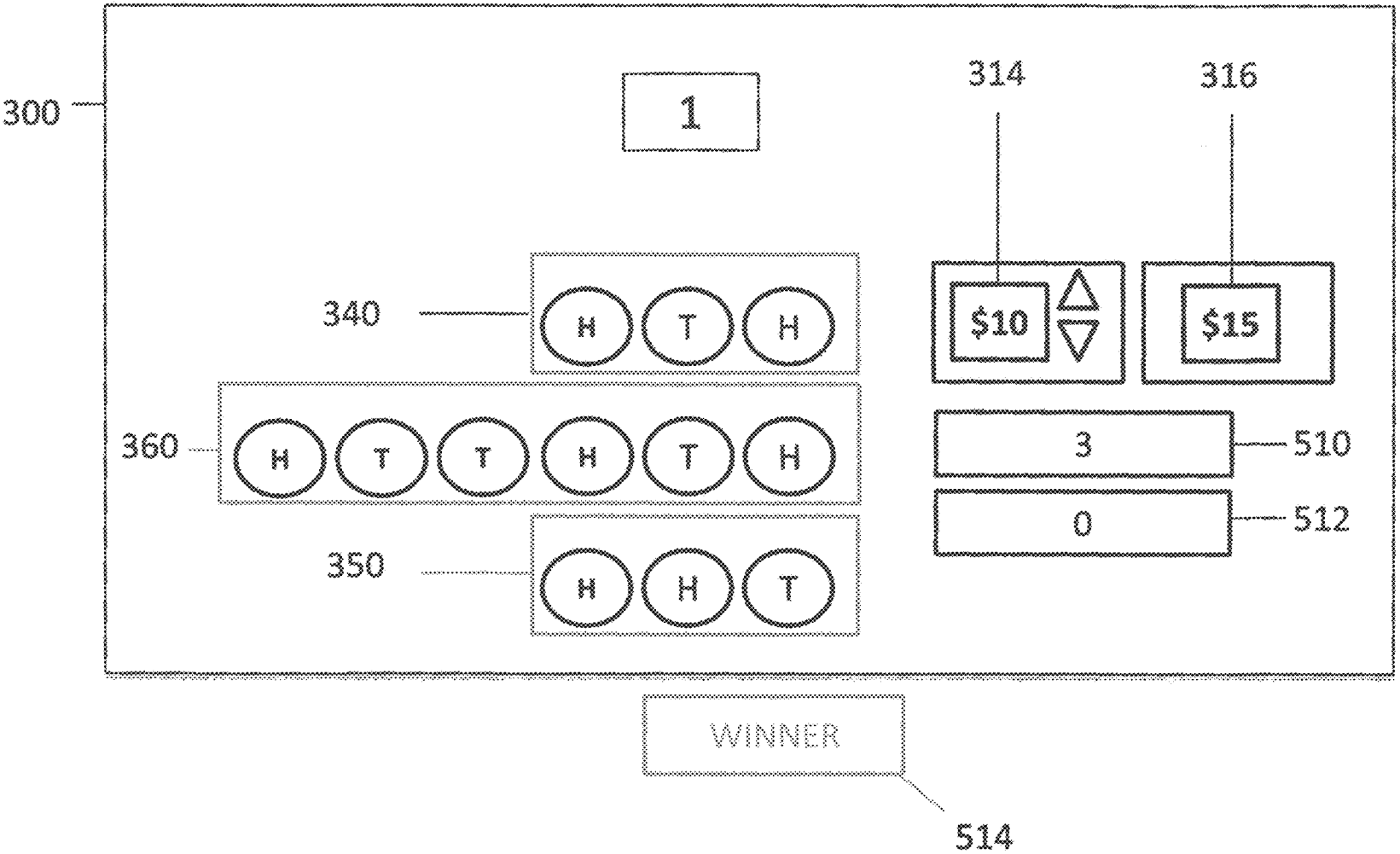
FIG. 11 is diagram of a game user interface according to an embodiment of the invention.

As shown in FIG. 11, an example of a $6^{th}$ coin toss is shown as "H" within a $6^{th}$ area of the actual coin toss sequence display 360. In addition, the coin toss matching number 318 can update to "3" to reflect a match between the user sequence and the actual sequence and the number of coins that match in the sequence. As described above such number can be provided by the matching process. In this example, the number of coins matching is equal to the total count of the game sequence, and since the user chosen sequence matches a selected portion of the actual coin toss sequence, the game interface provides a win notification 514.

It can be appreciated that in an alternative example, where actual coin toss sequence matches the house (machine) chosen sequence, a loss notification would otherwise be provided.

Various changes may be made to the system and process embodying the principles of the invention. For example, FIGS. 3, and 5-9 provide examples of a user interface, the appearance of which can be varied within the intended scope of the invention, and the information shown in the figures can be displayed in a different manner without deviating from the invention. The foregoing embodiments are set forth in an illustrative and not in a limiting sense. The scope of the invention is defined by the claims appended hereto.

I claim:

1. A coin toss gaming machine comprising:

a coin tossing apparatus, wherein the coin tossing apparatus is adapted to toss a fair coin object providing a coin toss outcome;

at least one sensor to determine said coin toss outcome;

a player interface adapted to allow a user to place and receive bets and select various options;

a processing system adapted to control at least the coin tossing apparatus; wherein the processing system is adapted to initiate a coin toss;

a flexible membrane;

a transparent enclosure, said transparent enclosure surrounding at least a portion of said flexible membrane; and a plurality of linear actuators disposed proximate to said flexible membrane, whereby striking of the membrane by the actuators enables a coin to flip.

2. The coin toss gaming machine according to claim 1 further comprising:

at least one sensor having processing adapted to determine a position of said coin;

actuator processing adapted to activate said actuators according to protocols, said protocols including activating at least one of said actuators according to said position.

3. The coin toss gaming machine according to claim 1 further comprising:

wherein said protocols further include at least one protocol selected from the group of:

activating at least one of said actuators according high coin flip energy;

activating at least one of said actuators according medium coin flip energy;

activating at least one of said actuators according low coin flip energy;

activating at least one of said actuators according optimal flip energy;

activating at least one of said actuators according to a priority of said actuator in a predetermined sequence; and including activating at least one of said actuators according at least once coin characteristic of said coin, said characteristic including at least weight of said coin.

4. The coin toss gaming machine according to claim 1 further comprising:

a contingent reward delivery apparatus.

5. The coin toss gaming machine according to claim 1 further comprising:

a fair coin for use by the coin-tossing device.

6. The coin toss gaming machine according to claim 1 wherein said player interface includes processing adapted to allow a user select a player sequence; to generate a house sequence; to initiate at least one actual coin flip; to receive an outcome of said actual coin flip; to compare said player sequence, house sequence, and said outcome; and to allow a user to initiate at least one additional coin flip, whereby said actual coin flip and said least one additional coin flip comprise an actual coin flip sequence.

7. The coin toss gaming machine according to claim 6 wherein said player interface further includes processing adapted to compare said player sequence, house sequence, and said actual coin flip sequence, whereby a comparison is obtained; to shift a comparison of said player sequence, house sequence, and said actual coin flip sequence until said comparison is equivalent to a match.

8. A coin toss gaming machine comprising:

a coin tossing apparatus, wherein the coin toss apparatus is adapted to toss a fair coin object providing a coin toss outcome;

at least one sensor to determine said coin toss outcome;

a player interface adapted to allow a user to place and receive bets and select various options;

a processing system adapted to control at least the coin tossing apparatus; wherein the processing is adapted to initiate a coin toss;

a coin acceptance apparatus adapted to receive the fair coin supplied by a player, a sensor adapted to determine at least one coin characteristic;

and a processor adapted to ensure the coin is fair according to predetermined parameters;

and wherein said apparatus is adapted to measure at least one coin characteristic, said coin characteristic including at least a weight of said coin.

9. A method for conducting a coin toss game, the method comprising:

selecting a sequence length limit;

providing a player sequence at a beginning of a game, wherein a player is prompted to select a player sequence comprising a plurality of coin toss outcomes, wherein said player chooses a coin toss outcome from the group consisting of a head (H) and a tail (T), and wherein said player sequence has a length, and said length is equivalent to said sequence length limit;

displaying an image of said player sequence on a user interface;

receiving at least one wager from a player;

providing a house sequence at a beginning of a game, wherein said house machine selects a house sequence comprising a plurality of coin toss outcomes, wherein said outcome is associated with a value, and wherein said house sequence has a length, and said length is equivalent to said sequence length limit;

displaying an image of said house sequence on a user interface performing a plurality of actual coin tosses wherein each of said coin toss has an outcome, wherein said plurality of coin tosses comprises an actual coin toss sequence, and has a count and said count is equivalent to said sequence length limit;

detecting a value of each of said plurality of coin toss outcomes, displaying an image of said coin toss on said user interface, comparing said actual coin toss sequence with said player sequence, and providing a win notification if said coin toss sequence is equivalent to said player sequence;

comparing said values of said coin toss outcome with said house sequence, and providing a lose notification if said coin toss sequence is equivalent to said house sequence;

performing an additional actual coin toss, wherein said coin toss has a value, detecting an additional value of each of said additional coin toss outcome, displaying an image of said additional coin toss on said user interface, appending the additional value to said actual coin toss sequence at the end of said sequence, and forming an additional coin toss sequence;

comparing said values of said additional coin toss sequence with said player sequence, and providing a win notification if said additional coin toss sequence is equivalent to said player sequence; and comparing said values of said additional coin toss sequence with said first machine selected outcome, and providing a lose notification if said additional coin toss sequence is equivalent to said house sequence.

10. The method according to claim 9 further comprising the steps of wherein said house machine chooses a coin toss outcome from the group consisting of a head (H) and a tail (T), receiving an additional wager.

11. The method according to claim 9 further comprising the steps of continuing to perform the steps of:

performing an additional coin toss and recording an additional outcome, displaying an additional image of an additional outcome comparing said additional coin toss outcome with an additional user predicted outcome, and providing a win notification if said additional user predicted outcome is equivalent to said additional coin toss outcome;

comparing said additional coin toss outcome with said additional machine selected outcome, and providing a lose notification if said additional machine predicted outcome is equivalent to said additional coin toss outcome;

until said either a win notification is provided or a lose notification is provided or said number of said first image and additional images equal said count, providing a lose notification if said first image and additional images equal said count.

12. The method according to claim 9 further comprising the steps of:

providing a coin toss video replay on a user interface.

13. The method according to claim 9 further comprising the steps of:

receiving an additional wager after each coin toss.

14. The method according to claim 9 further comprising the steps of:

offering a choice to set a minimum and maximum length of a sequence offered to the user is under program control by an agent authorized to program the device.

15. The coin toss gaming machine according to claim 1 wherein said player interface includes a player sequence display said player sequence display including an image of the coin.

16. The coin toss gaming machine according to claim 1 wherein said player interface includes an input selector, said input selector being adapted to receive a player wager.

17. The coin toss gaming apparatus according to claim 1 wherein said sensor comprises a camera.

18. A method for conducting a coin toss game, the method comprising:

selecting a sequence length limit, providing a player sequence at a beginning of a game, receiving at least one wager from a player, providing a house sequence at a beginning of a game, performing a plurality of coin tosses wherein each of said coin toss has an outcome, wherein said plurality of coin tosses comprises a coin toss sequence, and has a count and said count is equivalent to a sequence length limit;

comparing said coin toss sequence with said player sequence, comparing a value of said coin toss outcome with said house sequence, performing an additional coin toss, wherein said coin toss has a value;

detecting an additional value of each of said additional coin toss outcome, and appending the additional value to said coin toss sequence at the end of said sequence, and forming an additional coin toss sequence.

* * * * *